US009336697B2

(12) United States Patent
Varma

(10) Patent No.: US 9,336,697 B2
(45) Date of Patent: May 10, 2016

(54) ADJUSTABLE MARKING DEVICE TO VISUALLY IDENTIFY VALVES IN A MULTI VALVE FLUID DISTRIBUTION AND/OR TRANSMISSION SYSTEM

(71) Applicant: Shivendra Nath Varma, Ancaster (CA)

(72) Inventor: Shivendra Nath Varma, Ancaster (CA)

(73) Assignee: CHIIPS INTERNATIONAL INC., Ontario (CA)

( * ) Notice: Subject to any disclaimer, the term of this patent is extended or adjusted under 35 U.S.C. 154(b) by 268 days.

(21) Appl. No.: 14/072,837

(22) Filed: Nov. 6, 2013

(65) Prior Publication Data

US 2015/0122171 A1 May 7, 2015

(51) Int. Cl.

| | |
|---|---|
| ***G09F 7/00*** | (2006.01) |
| ***G09F 3/00*** | (2006.01) |
| ***G09F 7/04*** | (2006.01) |

(52) U.S. Cl.
CPC ..... *G09F 7/04* (2013.01); *G09F 3/0295* (2013.01); *Y10T 29/49826* (2015.01)

(58) Field of Classification Search
CPC ..... G09F 3/0295; G09F 2003/0251
USPC ..... 116/209
See application file for complete search history.

(56) References Cited

U.S. PATENT DOCUMENTS

| | | | | |
|---|---|---|---|---|
| 1,960,748 | A | 4/1931 | Meunier | |
| 2,188,710 | A | 1/1940 | Giovanini et al. | |
| 5,138,784 | A | 8/1992 | Niwa | |
| 5,367,278 | A | 11/1994 | Yoshikawa | |
| 6,339,848 | B1 * | 1/2002 | Mayhood | A41F 9/002 2/338 |
| 7,926,196 | B2 | 4/2011 | Mueller et al. | |
| 2011/0252606 | A1 * | 10/2011 | Rothbaum | F16G 11/00 24/302 |
| 2011/0252607 | A1 * | 10/2011 | Rothbaum | B65H 75/285 24/303 |
| 2011/0252609 | A1 * | 10/2011 | Rothbaum | H01F 7/0263 24/306 |
| 2012/0295244 | A1 | 11/2012 | Perin | |

FOREIGN PATENT DOCUMENTS

| | | |
|---|---|---|
| CA | 2380255 | 10/2003 |

OTHER PUBLICATIONS

Notification of Transmittal of the International Search Report and Written Opinion; International Application No. PCT/CA2014/000788; mailed Jan. 23, 2015; 11 pages.

* cited by examiner

*Primary Examiner* — Daniel S Larkin
*Assistant Examiner* — Irving A Campbell
(74) *Attorney, Agent, or Firm* — Thomas & Karceski, P.C.

(57) ABSTRACT

An adjustable marking device for visual identification of a valve in a valve housing or a pipe comprises a substantially planar flexible body having a tail, a head, and a visual indicator. A permanent magnet is secured to the body for magnetic attachment to the housing or pipe. A fixing means holds the tail and the head when they are brought into overlapping proximity with one another to form an in use configuration to fit the housing or pipe. The visual indicator may be a color indicator and/or a directional indicator. A method is provided for visually identifying a valve in a valve housing or a pipe in a multi-valve distribution and/or treatment system by means of a color indicator and directional indicator of valve operation.

14 Claims, 7 Drawing Sheets

ADJUSTABLE MARKING DEVICE TO VISUALLY IDENTIFY VALVES IN A MULTI VALVE FLUID DISTRIBUTION AND/OR TRANSMISSION SYSTEM

TECHNICAL FIELD

The present disclosure relates to marking devices produced in an assortment of colors and a method to identify individual pipes and other enclosures housing valves in a multi-valve distribution and/or transmission system for fluids, such as water for municipal utility infrastructures, natural gas from utility companies, oil from refineries, steam from steam generators etc.

BACKGROUND ART

As an example, municipal water distribution and/or transmission systems infrastructures comprise of as a minimum: mainline, connection, drain, pressure district, pressure regulating and pressure maintaining valves. The absence of a proper identification system of the different types and sizes of regulating valves in a multi-valve setup, the fluid flow direction, or the valve operation direction have been the source of constant recurring problems and failures that have caused some districts to be deprived of water unnecessarily. There have been reports of accidental water cut-off to fire hydrants when it was most needed by fire fighters. Similarly, water from higher pressure pipes have been misdirected to low pressure type pipes which then burst and result in unnecessary and avoidable costly expenses for repairs. One industrial area, highly dependent on water for production and processing was deprived of water for a few days while the municipality was investigating the cause for water interruption. Over the last century, the absence of a worldwide municipality standard regarding the operation of water valves that are used has resulted in some valves manufacturers producing valves with a CLOCKWISE operation to OPEN and others with a COUNTER CLOCKWISE operation to OPEN. This has led to confusion, human error, and increased risk to employees, public safety, infrastructures, the environment and a waste of energy during the pumping of water continuously 24/7 due to an opened valve which should have been in a closed position, in the first place to prevent a continuous re-circulation of water. An improved and clearly visible permanent method of identification of each type of valve and the flow direction of fluid carrying pipe will address most of the problems caused by human error through guess work. Down time of water supply interruption will be reduced to a minimum.

United States Patent Publication No. US-2012-0295244-A1 (Perin et al.) teaches an apparatus and method for visually identifying valves in multi valve distribution and transmission systems. A colour coding system is established and color coded valve box inserts are made to specifications, inserted and secured into place at the opening of valve boxes. Each box insert has a tubular main body with an extending flange having a dimension larger than the upper edge of the tubular main body. The tubular body may be tapered to provide a clearance fit with the housing at the bottom of the tubular body, but an interference fit with the housing at the top, so as to hold the apparatus in place within the housing. The tapered shape could result in the apparatus being difficult to remove from the housing. The apparatus is selected for installation in a size where the extending flange is larger than would fit within a valve box, stopping the apparatus from being inserted beyond the upper edge of the tubular main body. Unfortunately, a fixed size moulded tubular piece is rendered useless by the smallest variation in the internal circumference or diameter of an opening to a valve box, housing or pipe. It would be necessary to stock many different fixed size moulded tubular apparatuses in order to enable an installer to be able to identify valves in housings made by different manufacturers and not of a single standard size. A further problem could arise if the fixed sized molded tubular apparatus becomes tilted out of plumb within the valve housing. The apparatus could become wedged at an angle within the housing, potentially interfering with access to the valve. Alternatively, the apparatus could slide down within the housing to a depth where it is no longer clearly visible to fulfill its visual identification function. Moreover, the apparatus is employs an outwardly extending upper flange to secure itself to the valve housing. The apparatus can only be secured if it is installed inside the housing. It could not be installed on the outside of the valve housing or on the outside of a pipe, as there would be no means for retaining the apparatus in position.

It is an object of the present invention to provide a marking device which is adjustable in diameter so as to accommodate installation on a range of valve housing or pipe diameters It is a further object of the present invention to provide a marking device which can be mounted securely to a valve housing in proper alignment so that the marking device does not become wedged, does not fall off due to improper alignment, and which can be readily removed and reinstalled when desired.

It is a further object of the present invention to provide a marking device which can be mounted to either the inside or the outside of a valve housing or a pipe.

SUMMARY OF THE INVENTION

An adjustable marking device for visually identifying a valve housing, or a pipe comprises a substantially planar flexible body having a tail, a head, and a visual indicator. A fixing means will hold the tail and the head when the tail and the head are brought into overlapping proximity with one another to form an in use configuration to fit said housing or pipe. A permanent magnet is secured to the body for magnetic attachment to said housing or pipe. The permanent magnet is secured to a front surface of the body. The body comprises, adjacent, the front surface thereof, a magnet cavity sized and shaped to securely receive the permanent magnet. The permanent magnet is constructed from sintered Neodymium $Nd_2Fe_{14}B$. The visual indicator may be a directional indicator or a colour indicator.

A marking method for visually identifying a valve housing or a pipe in a multi-valve fluid distribution and/or transmission system comprises the following steps. A colour-coding system is provided for identifying the valve housings or the pipes in the multi-valve fluid distribution and/or transmission system. An adjustable marking device having a substantially planar flexible body having a tail, a head; a fixing means to hold the tail and the head when they are brought into overlapping proximity with one another to form an in use configuration to fit the valve housing or pipe; a permanent magnet secured to the body for magnetic attachment to said housing or pipe; and a colour indicator is selected corresponding to a colour in the colour coding system The adjustable marking device is formed into an in use configuration, and, is magnetically attached to the valve housing or pipe.

The adjustable marking device may further comprise a directional indicator. In such instance, the method further comprises the following steps: identifying a directional operation of the valve; and, orienting the selected adjustable marking device so that the directional indicator indicates the directional operation of the valve before magnetically attaching the selected adjustable marking device to the valve housing or the pipe.

DETAILED DESCRIPTION OF EMBODIMENTS

Figure 1:
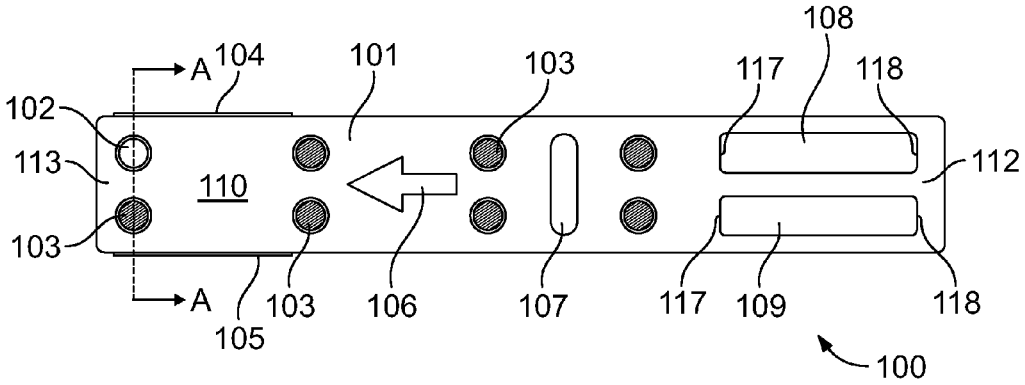
FIG. 1 shows a front view of an adjustable marking device in accordance with an embodiment of the present invention.

The present disclosure relates to an adjustable marking device, as indicated by reference numeral 100 in FIGS. 1-7 and a method for visual identification of valves in multi-valve distribution and/or transmission systems for fluids and the flow direction of the fluid carrying pipes, for municipal water infrastructures such as mainline, connection, drain, pressure district, pressure regulating and pressure maintaining valves.

The adjustable marking device comprises a substantially planar body having a tail and a head; a permanent magnet secured to the body for magnetic attachment to a valve housing or pipe, and a visual indicator. The visual indicator may be a colour indicator, or a direction indicator, or both.

Figure 3:
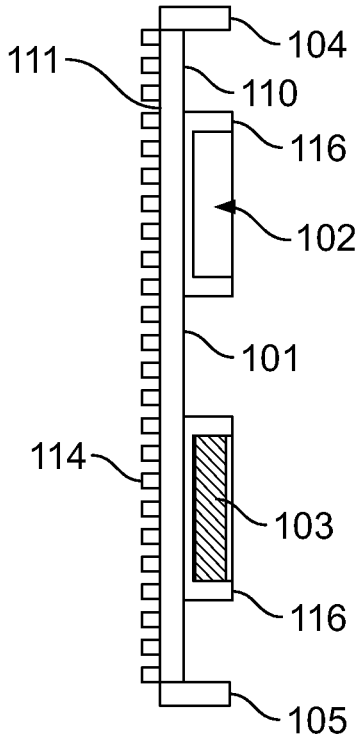
FIG. 3 shows an enlarged view of a cross section of the adjustable marking device of FIG. 1, taken along line A-A.
Figure 4:
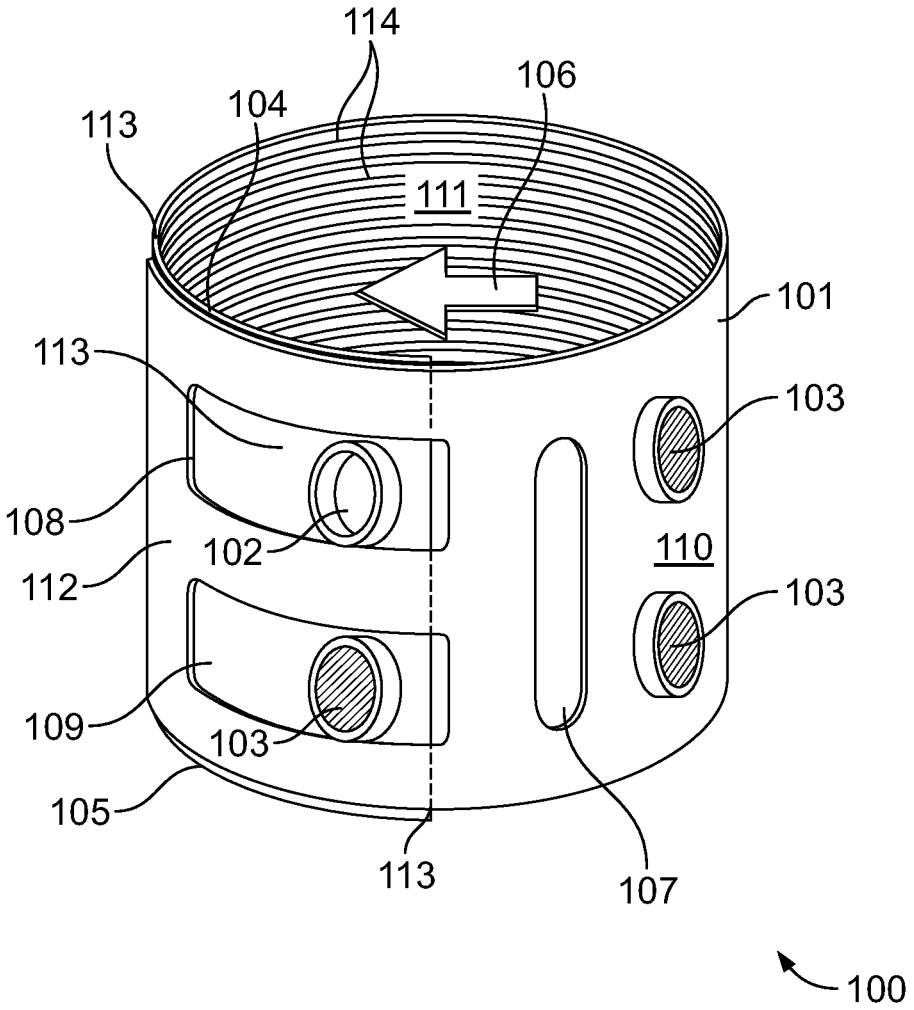
FIG. 4 is a perspective view of the adjustable marking device of FIG. 1 shaped in the form of a cylindrical piece ready for attachment to the inside of a valve housing.

Referring to FIG. 1-through FIG. 3, the adjustable marking device 100 comprises a flexible substantially planar body 101 having a tail 112 and a head 113. The main body has a front surface 110 and a back surface 111. The main body 101 is flexible. The flexibility of the main body 101 is integral to the adjustability of the adjustable marking device 100, as the tail 112 and the head 113 are brought into proximity with one another to form an in use configuration. In the in use configuration the flexible marking device 100 will conform to the shape and size of the pipe or valve housing which is to be marked. Although most often the head 113 and tail 112 are brought into proximity so as to form a cylindrical piece as seen in FIG. 4, to fit a pipe/housing 200 of circular cross section, it should be understood that the adjustable marking device 100 could also accommodate housings/pipes of other cross sections (e.g. oval, elliptical, square, etc.). A variety of pipe/housing diameters can be accommodated by a single adjustable marking device, simply by varying whether the head 113 and tail 112 are brought only to just overlap another, or are overlapped by a greater selected amount. This adjustability feature provides great convenience and flexibility to the front line installers for on-site attachment of the marking devices. There is variation in the diameter of housings or pipes produced by different manufacturers. An installer may encounter the housings of multiple manufacturers on a single project. A fixed size marking device is rendered useless for installation on a given housing if the housing has a different diameter than the marking device. Consequently, the installer would have to stock a wide range of different sized marking devices if they were each constructed in a fixed size from moulded tubular plastic or the like. The present invention provides an infinitely adjustable marking device which will accommodate significant variation in pipe/housing size within a standard size range. By way of example, municipal water valve housings may range from 12-16 cm (5-6 inches) in diameter. A single adjustable marking device according to the present invention can be installed to mark pipes/housings which vary in diameter from 12 to 16 Centimeters simply by increasing or decreasing the overlap of the head 113 and tail 112. This adjustment range would accommodate the size variation of a variety of pipes or valve housings manufactured by different manufacturers. The adjustable marking devices according to the present invention can be manufactured in all applicable size categories to suit any sized pipe/housing, not just municipal water systems. The present invention has applicability for marking pipes and valve housings in a wide variety of HVAC and industrial fluid management systems. Each such adjustable marking device could be fitted to a range of sizes within each category.

Although not essential to the functioning of the adjustable marking device in its broadest concept, the main body 101 should not only be flexible, but should also be elastic, i.e. capable of elastic deformation. If the main body 101 is capable of elastic deformation, then the adjustable marking device 100 will be able to be used on a pipe or valve housing and then removed and reused. If the main body 101 were constructed from a material which was flexible only, (such as aluminum or certain nylons it could be adjusted to the size and shape the housing/pipe 200, but might not successfully be reused for marking other housings/pipes subsequently. Having the main body 101 constructed from an elastic material will allow the adjustable marking device 100 to be reused. The main body 101 may be constructed from many elastic materials having high shear strength, good water, oil and grease resistance, and can maintain their mechanical integrity including flexibility, breakage and tear resistance, and fire retardancy when exposed to extreme temperatures, which is preferred because valve housings are subject to both hot and cold temperatures and exposed to the elements. It is preferred to construct the main body 101 by injection moulding from thermoplastic polyurethane (TPU) material. TPU material is resistant to tearing, resistant to abrasion, has excellent mechanical properties, combined with a rubber-like high elasticity, high shear strength, high transparency, good oil and grease resistance, and very good flexibility, TPU material is also resistant to extreme temperatures while still retaining its mechanical integrity including flexibility, breakage and tear resistance, and fire retardancy, which is preferred because valve housings are subject to both hot and cold temperatures and exposed to the elements.

Figure 5:
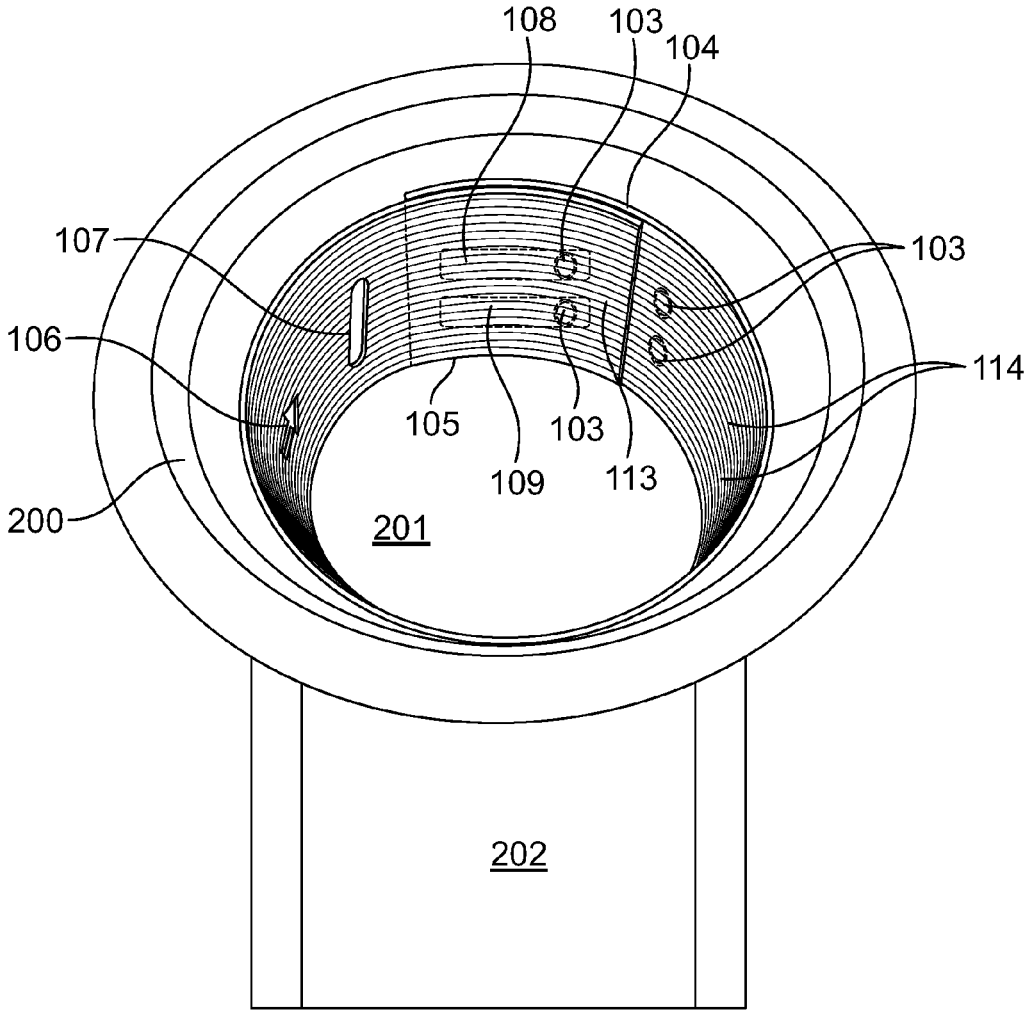
FIG. 5 is a perspective view of the adjustable marking device of FIG. 1 installed in the opening of a small valve housing.
Figure 6:
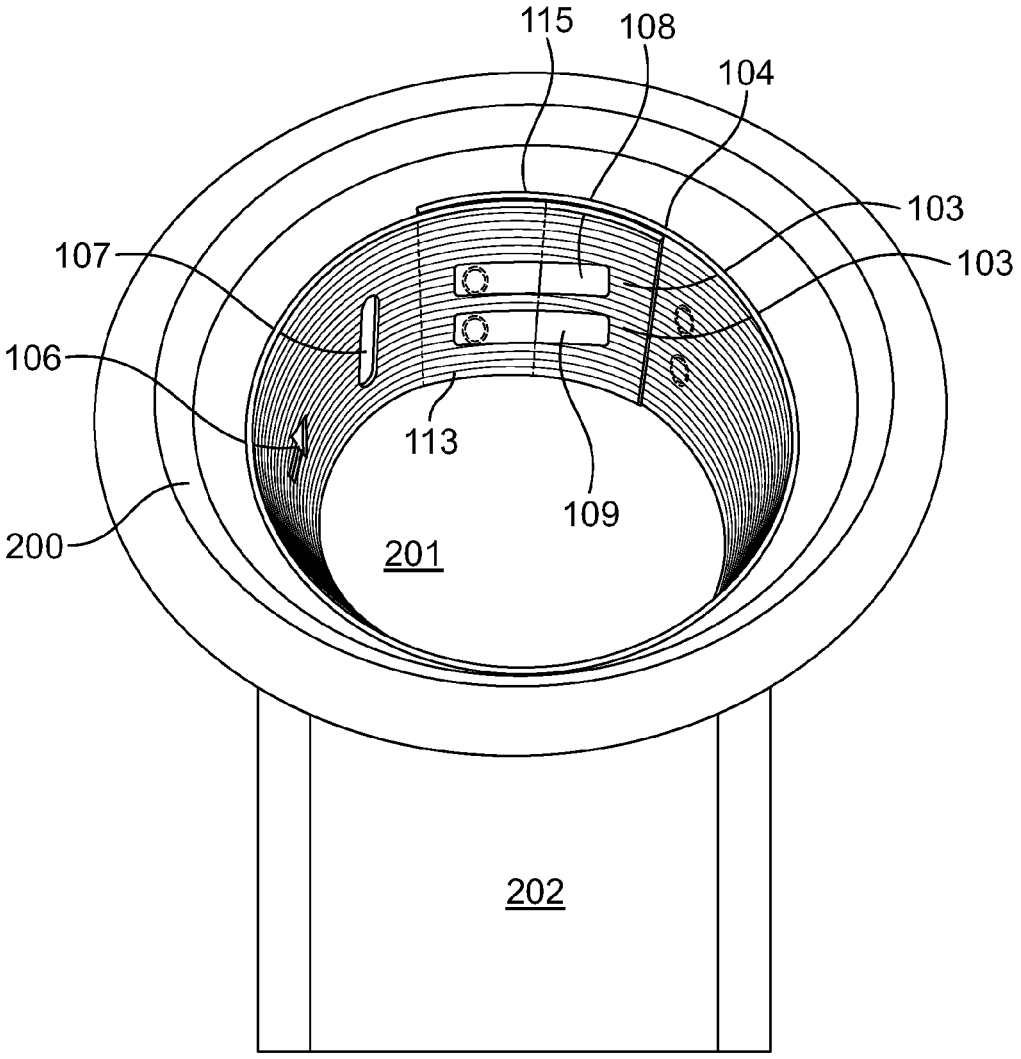
FIG. 6 is a perspective view of the adjustable marking device of FIG. 1 installed in the opening of a large valve housing.
Figure 7:
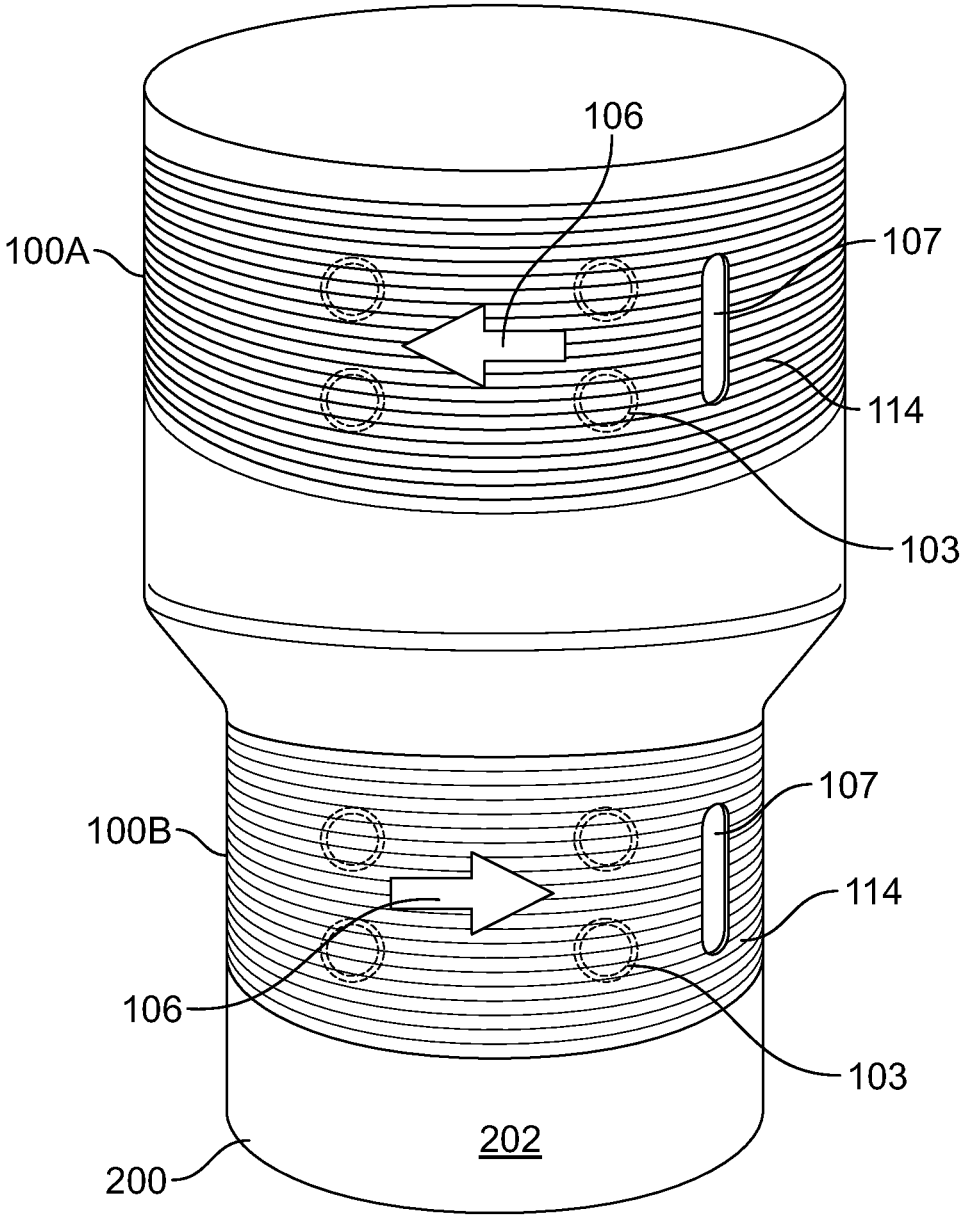
FIG. 7 is a perspective view of a large valve housing showing two adjustable marking devices according to FIG. 1, one being installed to indicate clockwise operation of a valve and the other installed to indicate counter clockwise operation of a valve.

The adjustable marking device 100 comprises a permanent magnet 103 for magnetic attachment to the housing/pipe 200. As can be seen in FIG. 5 through FIG. 7, the adjustable marking device 100 can be removably attached to either the inside or the outside of the housing/pipe 200. In the embodiment illustrated in the drawings, a plurality of permanent magnets 103 is used. The magnets 103 are secured to the main body 101 and are exposed for magnetic contact with the housing/pipe 200.

It should be noted that the quantity, type and size of the permanent magnets 103 will vary depending on the length of the flexible, reversible and rotatable magnetic marking device 100 to maintain the optimum magnetic field for a permanent adhesion to the housing/pipe 200. Although several types of permanent magnets (including standard black magnets) could be used, they are not preferred due to weakness of the magnetic field (necessitating direct physical contact between the surface of the magnet and the housing), brittleness, etc. It is preferred to construct the permanent magnets from sintered Neodymium $Nd_2Fe_{14}B$ permanent magnets with a grade of no less than N35. Such magnets are made from an alloy of rare earth Neodymium, Iron and Boron to form the $Nd_2Fe_{14}B$ tetragonal crystalline structure. $Nd_2Fe_{14}B$ permanent magnet is preferred because it is one of the strongest types of permanent magnets. The tetragonal structure has exceptionally high uniaxial magneto-crystalline anisotropy. This gives the compound the potential to have high coercivity, i.e. resistance to being demagnetized. The compound also has a high saturation magnetization. Therefore, as the maximum energy density is proportional to the saturation magnetization, this magnetic phase has the potential for storing large amounts of magnetic energy for an extremely high remanence, a high Curie temperature of between 310 to 400 degrees Celsius, flexural strength, compressive strength, tensile strength, and hardness. If $Nd_2Fe_{14}B$ magnets are used, they do not need to be in physical contact with the housing to which the mounting device is attached. They have a sufficiently strong magnetic field to hold the adjustable marking device in place on a housing with the magnets being in close proximity to, but outside physical contact with the housing. The magnets may be chrome plated in order to avoid rust corrosion in applications where the magnets may be exposed to water or oxidizing agents.

The permanent magnets 103 can be mounted on the main body 101 by a number of means. For example, the magnets could be glued to the body, though glued mountings may fail over time, particularly in situations where rigid objects (magnets) are glued to a flexibly body. Holes could be punched in the body and then magnets press fit into the holes. This mounting means is not preferred since it would expose the magnets to possible breakage, and the magnets would be equally exposed to both surfaces of the body, eliminating the possibility of selectively insulating one side of the magnet. Magnets could be inset into retainers which are then attached to the body (by post and backing systems or the like). This mounting means is not preferred since manufacture would be complicated and multi-stage, and there is significant potential for the magnets to become dislodged from the body.

Figure 2:
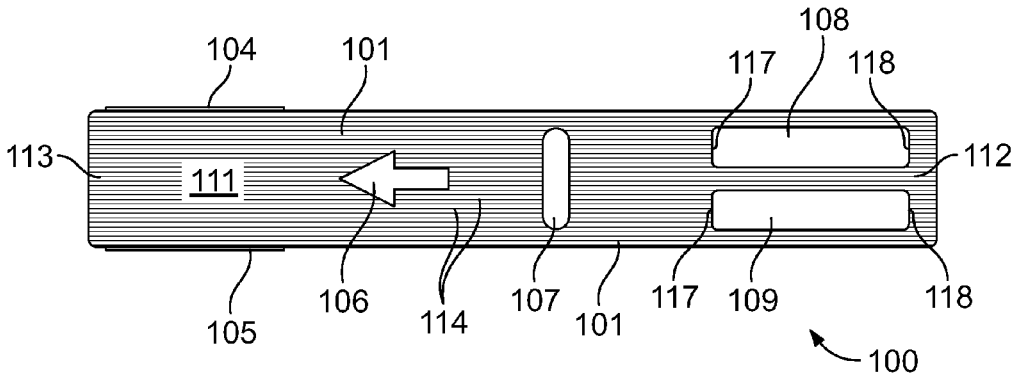
FIG. 2 shows a back view of the adjustable marking device of FIG. 1.

The preferred means for securing the permanent magnets is to mould the body 101 with a plurality of magnet cavities 102 on the front surface 110 thereof, sized and shaped to retain one of the permanent magnets 103. For illustration purposes, FIGS. 1 and 2 show a body 101 having a plurality of cavities 102. All but one of the cavities has a magnet retained in it. One cavity 102 has been shown empty to provide detail of the preferred means for securing the permanent magnets. The inner diameter of each magnet cavity 102 is made slightly less than the diameter of the permanent magnet 103 so that when the latter is inserted into the magnet cavity 102 under pressure, the flexibility and rubber-type high elasticity of the thermoplastic polyurethane (TPU) material holds the permanent magnet tightly in place under compression. As shown in FIG. 3, the magnetic cavities 102 are preferably integrally formed as part of the body 101. Since magnets are rather brittle, it is beneficial to avoid situations where they could be jarred or smashed into a hard metal surface. As will be observed in FIG. 3, the depth of each magnet cavity 102 is deeper than the thickness of the permanent magnet 103 so that when the permanent magnet 103 is seated and recessed inside the cavity 102, the rim 116 of the magnet cavity 102 extends beyond the surface of the magnet 103. The rim 116 of the cavity holds the magnet 103 in close proximity to, but not in physical contact with the housing or pipe to which it is magnetically attached when installed. The rim 116 serves as a bumper to protect against damage to the permanent magnet 103 by impact with the receiving surface of the opening to the valve housing or the surface of the fluid carrying pipe.

As seen in FIG. 2 and FIG. 3, the back surface 111 of the body 101 has a plurality of protrusions 114 which provide stability and increase the outward adhesion pressure to the magnet cavity 102 thereby increasing the magnetic force of the permanent magnets 103 exerted the near the front surface 110 of the body 101. The increase in magnetic strength along the front surface 110 is beneficial in ensuring that on the front surface permanent magnets' magnetic field is unobstructed for a very strong adhesion to the pipe/housing. This strong adhesion prevents any vertical or horizontal displacement or dropping of the adjustable marking device to the bottom of the valve housing opening. At the same time the protrusions 114 insulate the back body surface 111 from exposure to the permanent magnets. This insulation reduces the magnetic field strength of the permanent magnets 103 as it is experienced near the back surface 111 of the main body. The reduced strength will keep any inserted metal tool from being drawn to too close to the magnetic field when inserted into the valve housing to adjust the valve.

The protrusions 114 are shown in the drawings as a plurality of horizontal parallel ribs, the particular shape and arrangement of the protrusions is not essential, and could be varied. The tail 112 and the head 113 of the body 101 are brought into overlapping proximity to form the in use configuration of the adjustable marking device 100, as best shown in FIG. 4. The tail 112 and head 113 are held in the in use configuration by a fixing means 115. Several different fixing means could be employed such as a plurality of interlocking grooves provided front 110 and back 111 surfaces of the head 113 and tail 112, or snap fasteners having at least one mating component mounted on each of the head and the tail.

In the preferred embodiment shown in the drawings, the fixing means 115 comprises the magnets 103 which are positioned adjacent the head 113 being retained in the sizing cut-out 108,109 in the tail 112. As shown in FIG. 1 and FIG. 3, the first and second leading edge guides 104, 105 each protrude beyond the front surface 110 at the head 113 of the main body 101 and extend in width beyond the width of the remainder of the main body 101. The main body 101 is not extended in width in the vicinity of the tail 112, such that when the head 113 and the tail 112 are brought together, the tail 112 will slide between the leading edge guides 105,104 and be held in precise alignment with the head 113, as can be seen in FIG. 4.

The front surface 110 of the body 101 has the exposed magnet cavities 102 containing the magnets 103 and is directed toward a surface of the housing/pipe 200 for magnetic engagement therewith. The adjustable marking device 100 can be applied to either the internal surface 201 of a pipe/housing 200 as shown in FIGS. 5, and 6, or to the external surface 202 as shown in FIG. 1 and FIG. 4 shows the adjustable marking device 100 in the in use configuration for installation inside a pipe/housing 220 for magnetic engagement with the internal surface 201 thereof. The magnets 103 are directed outwardly such that they will face toward the internal surface of 201 of the pipe/housing 200 when installed, and the back surface, having protrusions 114 insulating the magnets, is directed inwardly, away from the pipe/housing, and toward the interior of the housing holding the valve (not shown). The body 101 can be formed into an in use configuration for attachment to the external surface (FIG. 7) by bringing the tail 112 and the head 113 into overlapping proximity from the opposite direction (i.e. inside out). The resulting in use configuration has the front surface 110 with the magnets 103 directed inwardly toward the pipe/housing and the back surface with the protrusions 114 directed outwardly away from the pipe/housing.

The body 101 forms at least one sizing cut-out positioned adjacent the tail 112. As shown in the drawings, it is preferred to form at least two sizing cut-outs 108, 109. The sizing cut-outs are preferably elongated and have a proximal end closer 117 to the head 113 and a distal end 118 closer to the tail 112. The sizing cut-outs 108,109 are sized and positioned to receive a pair of the magnets 103 therethrough. The use of elongated cut-outs permits infinite adjustability within the length of the cut-out 108,109. The sizing cut-outs 108,109 facilitate the size adjustment of the adjustable marking device 101 to fit pipes/housings of varying sizes. When the adjustable marking device 100 is fitted to a pipe/housing 200, there is an amount of overlap between the head 113 and the tail 112. The magnets 103 will pass through the cut-outs 108, 109 at a position determined by the extent of overlap between the head 113 and tail 112. The smaller the diameter, the more overlap and the closer to the proximal ends 117 of the cut-outs 108, 109, is the position where the magnets 103 will pass through the cut-outs. FIG. 5 shows the adjustable marking device 100 mounted within a housing 200 having a small diameter. There is a large overlap between the head 113 and the tail 112. The overlap is so large that the cut-outs 108, 109 and the pair of magnets 103 passing through them are not visible (but rather are shown in dotted outline). FIG. 6 shows the adjustable marking device 100 mounted within a housing 200 having a larger diameter. There is very little overlap between the head 113 and the tail 112. Large portions of the cut-outs 108,109 are visible, and the magnets 103 pass through the cut-outs 108,109 toward their distal ends. The magnets 103 are still covered by a portion of overlap and are not visible (but rather are shown in dotted outline).

Although less preferred, it would be possible to provide either a single large elongated cut-out to receive a pair of magnets, or a plurality of smaller cut-outs (such as circles) to receive individual magnets at preset positions along the body 101 in order to facilitate adjustment size adjustment of the adjustable marking device. The less preferred cut-out shapes may impair the stability of the in use configuration and/or may limit the range of adjustment of the marking device.

As mentioned above, the adjustable marking device comprises a visual indicator 120. The visual indicator may be directional indicator 106 to identify whether a valve has a clockwise or counter clockwise operation. The directional indicator could take the form of an arrow or device applied to the front and back surfaces of the body 101. In accordance with the preferred embodiment of the invention shown in the drawings, the directional indicator is an arrow-shaped opening which can be seen from both sides of the body 101. The body 101 is molded to form an arrow-shaped hole 106 therethrough oriented in a direction parallel to the longitudinal orientation of body 101. As best seen in FIG. 7, the directional indicator 106 can be used to identify either the clockwise or counter clockwise direction. FIG. 7 shows two marking devices mounted to the external surface 202 of a pipe/housing 200 to illustrate the relative positioning of the adjustable marking device and the directional indicator 106 to indicate directionality of valve operation. The marking device 100 is simply mounted to the pipe/housing 200 right side up 100A for one direction (i.e. clockwise) or upside down 101B for the reverse direction (i.e. counter clockwise).

The adjustable marking device 100 of the present invention further comprises an access opening 107 formed through the body 101. The access opening can be used to run wires to the valve etc.

A further feature of the adjustable marking device 100 is the ability to establish a colour code in order to identify different types of fluid carrying pipes, different pressure capacities, different flow directions etc. Each municipality or gas distributing or steam generating or oil refining entity can create its own color-coding system using a color set having an appropriate number of different colors to identify each type of valve and/or flow direction of fluid carrying pipe. A color-coding chart may also be created to allow front line on-site field staff to easily identify each type of valve by cross-referencing the color-coded chart to different types of valves.

The adjustable marking device 100 further comprises a colour indicator. The colour indicator can be formed in multiple ways. A colour swatch could be applied to the front surface and the back surface of the body 101. Alternatively, the colour indicator can comprise the colour of the entirety of the body 101.

Preferably the body 101 is molded from a flexible, elastic material that is available in an assortment of different colors. Most preferably thermoplastic polyurethane which is available in an assortment of colours is the moulding material. When the body 101 is moulded it is inherently the colour of the coloured starting material. The colour would be visible from both the front and back sides of the body, and would not require any maintenance for color retention after it has been attached to valve housings and/or fluid carrying pipes. Less preferably, each body 101 could be manufactured of a single base material and then later painted or otherwise coated with a coloured material.

Figure 8:
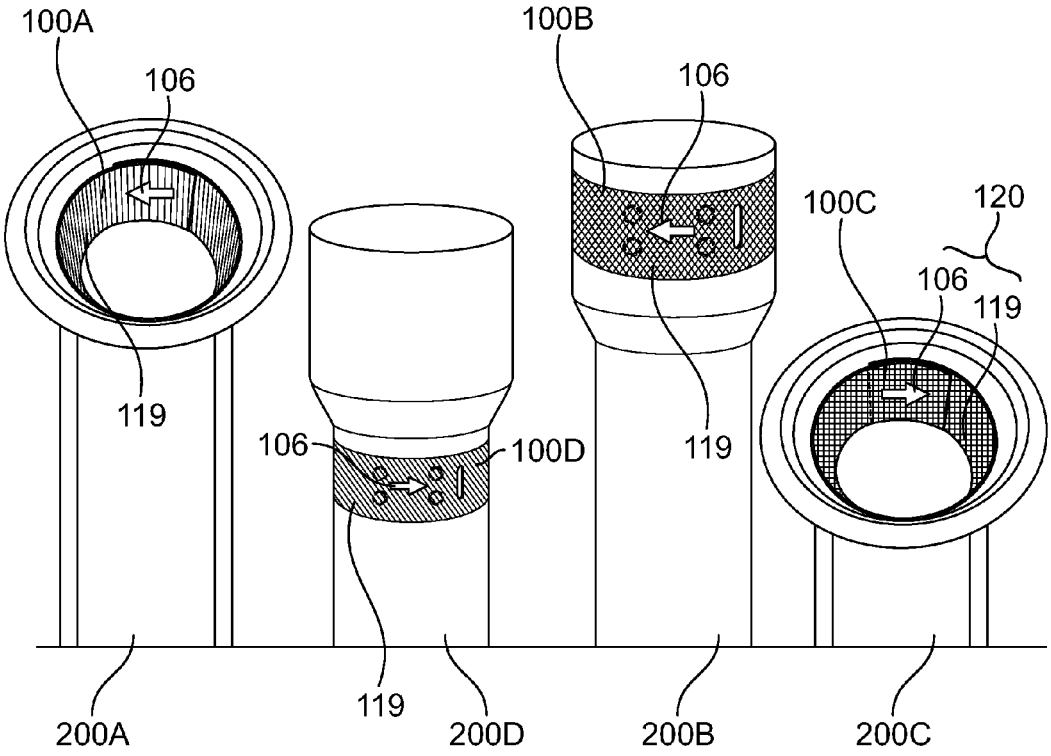
FIG. 8 is an exploded view of a plurality of the adjustable marking devices of FIG. 1 installed on a plurality of valve housings.

FIG. 8 illustrates the use of a plurality of adjustable marking devices manufactured in a plurality of colours (represented in the differing patterns of shading). Each different coloured marking device is identified by one of references 100A-100D. As shown in this illustrative example, the magnetic marking devices 100A-100D illustrate possible combinations of mounting location, direction of valve operation, and size of housing. Reference 100A shows a magnetic marking device to attach to the inside surface of a large housing 200A with a counter clockwise valve operation (100A); Reference 100B shows a marking device configured to attach to the outside surface of a large housing 200B with a clockwise valve operation (100B); Reference 100C shows a marking device configured to attach to the inside surface of a small housing 200C with a counter clockwise valve operation (100C); Reference 100D is a marking device configured to attach to the outside surface of a small housing 200D with a clockwise valve operation (100D). There is no physical difference between the marking devices 100A-100D, apart from their varying colours. All other variables are achieved by alternating the orientation (right side up, upside down, inside out and outside out) of adjustable marking devices as applied to the various valve housings.

That which is claimed is:

1. An adjustable marking device for visually identifying a valve housing, or a pipe comprising:

a. a substantially planar flexible body having a tail, a head, and a visual indicator;

b. said body forming a sizing cut-out to receive a magnet therethrough to hold the tail and the head when the tail and the head are brought into overlapping proximity with one another to form an in use configuration to fit said housing or pipe; and, c. a permanent magnet secured to a front surface of the body for magnetic attachment to said housing or pipe.

2. The adjustable marking device of claim 1, wherein the body comprises, adjacent, the front surface thereof, a magnet cavity sized and shaped to securely receive the permanent magnet.

3. The adjustable marking device of claim 2, wherein the magnet cavity is integrally formed with the body.

4. The adjustable marking device of claim 3, wherein the permanent magnet is constructed from sintered Neodymium $Nd_2Fe_{14}B$.

5. The adjustable marking device of claim 4, wherein the body comprises, adjacent a back surface thereof, a plurality of protrusions.

6. The adjustable marking device of claim 1, wherein the sizing cut-out is positioned adjacent to the tail.

7. The adjustable marking device of claim 6, wherein the sizing cut-out is elongate and has a proximal end and a distal end.

8. The adjustable marking device of claim 7, wherein the body forms an access opening therethrough.

9. The adjustable marking device of claim 8, wherein the visual indicator is a directional indicator.

10. The adjustable marking device of claim 9, wherein the directional indicator is visible on the front surface and the back surface of the body.

11. The adjustable marking device of claim 10, wherein the directional indicator is an arrow-shaped hole formed through the body.

12. The adjustable marking device of claim 8, wherein the visual indicator is a colour indicator.

13. The adjustable marking device of claim 12, wherein the colour indicator comprises the colour of the entirety of the body.

14. The adjustable marking device of claim 1, wherein a substantially planar flexible body is elastic.

* * * * *